US005401381A

United States Patent [19]

Seidel et al.

[11] Patent Number: 5,401,381

[45] Date of Patent: Mar. 28, 1995

[54] PROCESS FOR PHOSPHATING METALLIC SURFACES

[75] Inventors: Reinhard Seidel, Monheim; Horst-Dieter Speckmann, Langenfeld; Karl-Dieter Brands, Duesseldorf, all of Germany; Gerard Veldman, Swalmen, Netherlands; Raschad Mady, Frechen, Germany

[73] Assignee: Henkel Kommanditgesellschaft auf Aktien, Duesseldorf, Germany

[21] Appl. No.: 129,163

[22] PCT Filed: Mar. 30, 1992

[86] PCT No.: PCT/EP92/00703

§ 371 Date: Oct. 6, 1993

§ 102(e) Date: Oct. 6, 1993

[87] PCT Pub. No.: WO92/17628

PCT Pub. Date: Oct. 15, 1992

[30] Foreign Application Priority Data

Apr. 6, 1991 [DE] Germany ..... 41 11 186.9

[51] Int. Cl.[6] ..... C25D 11/36

[52] U.S. Cl. ..... 205/177; 204/188; 204/199; 204/318; 205/318

[58] Field of Search ..... 205/188, 177, 318, 199

[56] References Cited

U.S. PATENT DOCUMENTS

| | | | |
|---|---|---|---|
| 3,449,229 | 6/1969 | Freeman et al. | 205/318 X |
| 4,639,295 | 1/1987 | Miyamoto et al. | 205/318 X |
| 4,865,653 | 9/1989 | Kramer | 205/111 |
| 4,874,480 | 10/1989 | Sonoda et al. | 205/212 |

FOREIGN PATENT DOCUMENTS

| | | |
|---|---|---|
| 0171790 | 2/1986 | European Pat. Off. . |
| 0288853 | 11/1988 | European Pat. Off. . |
| 2262134 | 9/1975 | France . |
| 50-161429 | 12/1975 | Japan . |
| 52-047537 | 4/1977 | Japan . |
| 60-211080 | 10/1985 | Japan . |
| 62-260073 | 11/1987 | Japan . |
| 1-2191913 | 9/1989 | Japan . |
| 8503089 | 7/1985 | WIPO . |

OTHER PUBLICATIONS

M. H. Abbas, Finishing, Oct. 1984, pp. 30–31.

*Primary Examiner*—John Niebling
*Assistant Examiner*—William T. Leader
*Attorney, Agent, or Firm*—Ernest G. Szoke; Wayne C. Jaeschke; Norvell E. Wisdom, Jr.

[57] ABSTRACT

A process is disclosed for phosphating metallic surfaces, particularly electrolytically or hot dipped galvanized steel strip surfaces, by dip or spray processing the metallic surfaces with acidic aqueous phosphating solutions, wherein the workpieces are cathodically treated at the same time with a direct current. The process is characterized by (a) the use of phosphating solutions that contain the following components: $Zn^{+2}$ cations in a range from 0.1 to 5 g/l; $PO_4^{-3}$ anions in a range from 5 to 50 g/l; $NO_3^-$ anions in a range from 0.1 to 50 g/l; as well as $Ni^{+2}$ cations in a range from 0.1 to 5 g/l and/or $Co^{+2}$ cations in a range from 0.1 to 5 g/l; (b) the observance of the following conditions: pH value of the phosphating solutions in a range from 1.5 to 4.5; temperature of the phosphating solutions in a range from 10° to 80° C.; duration of treatment in a range from 1 to 300 sec, (c) simultaneous cathodic treatment of the workpiece during phosphating with a direct current having a density in the range from 0.01 to 100 mA/cm$^2$.

20 Claims, No Drawings

PROCESS FOR PHOSPHATING METALLIC SURFACES

FIELD OF THE INVENTION

This invention relates to a process for phosphating metal surfaces, preferably electrolytically galvanized or hot-dip-galvanized steel strip surfaces, by the dip or spray-dip treatment thereof with acidic aqueous solutions which, in addition to zinc, phosphate and nitrate ions, contain ions of at least one other divalent metal, the workpieces being cathodically treated with a direct current at the same time.

STATEMENT OF THE RELATED ART

The use of electrical current in phosphating processes is known per se. Thus, a cathodic treatment, for example, accelerates the phosphating process (see M. H. Abbas, Finishing, October 1984, pages 3–31). Anti-corrosion layers can be deposited on galvanized steel surfaces by means of acidic aqueous solutions based on aluminum phosphate and/or magnesium phosphate or polycondensed phosphoric acid with simultaneous application of cathodic currents (cf. JP-A-77/047 537, JP-A-75/161 429 and JP-A-89/219 193). In addition, phosphate coatings of high abrasion resistance can be formed on metal surfaces using acidic phosphating baths containing phosphoric acid, manganese and copper ions with simultaneous application of cathodic currents (JP-A-87/260 073). JP-A-85/211 080 relates to a process for producing anti-corrosion layers on metal surfaces using zinc phosphating solutions with periodic application of a cathodic current. In this process, a corrosion-resistant protective layer is also produced in particular at the edges of the metal surfaces to be treated. A similar process is described in EP-A-0 171 790. In this process, the metal surfaces, which have already been zinc-phosphated in the usual way, are treated with an acidic aqueous solution containing zinc, phosphate and chlorine ions, a direct current being simultaneously applied to the metal surfaces acting as anodes.

On the other hand, it has long been known to the expert that high nickel contents in phosphate coatings lead to particularly good protection against corrosion. However, it is also known in this connection that, to obtain high nickel contents in the phosphate coatings, the phosphating solutions to be used are also required to have high nickel contents. On the one hand, this leads to higher process costs because of the high price of nickel. On the other hand, relatively large quantities of toxic nickel compounds have to be removed from the spent phosphating solutions because, in general, only about 2% of the nickel from the phosphating solutions is incorporated in the phosphate coatings. Thus, a high nickel zinc phosphating process is known from WO-A-85/03 089 for example. In this process, extremely high concentrations of nickel are used for phosphating. It is generally pointed out that, in principle, the nickel may be partly replaced by a number of monovalent or divalent cations selected, for example, from cobalt, manganese and magnesium. It is also pointed out that the nickel content of the solution to be used must be at least 1.0 g/l. The ratio to be established between a low zinc content and a high nickel content is a key part of the technical teaching.

DESCRIPTION OF THE INVENTION

By contrast, the problem addressed by the present invention was to provide a process for phosphating metal surfaces in which the incorporation rate of nickel and/or cobalt in the phosphate coatings formed could be significantly increased although only comparatively low concentrations of nickel and/or cobalt cations are present in the phosphating baths used.

SUMMARY OF THE INVENTION

Accordingly, the present invention relates to a process for phosphating metal surfaces, preferably electrolytically galvanized or hot-dip-galvanized steel strip surfaces, by the dip or spray-dip treatment thereof with acidic aqueous solutions which, in addition to zinc, phosphate and nitrate ions, also contain ions of at least one other divalent metal, characterized in that:

a) the phosphating solutions used contain the following components:
   $Zn^{2+}$ cations in a quantity of 0.1 to 5 g/l,
   $PO_4^{3-}$ anions in a quantity of 5 to 50 g/l,
   $NO_3^-$ anions in a quantity of 0.1 to 50 g/l and
   $Ni^{2+}$ cations in a quantity of 0.1 to 5 g/l and/or
   $Co^{2+}$ cations in a quantity of 0.1 to 5 g/l,
b) the following conditions are maintained:
   pH value of the phosphating solutions in the range from 1.5 to 4.5,
   temperature of the phosphating solutions in the range from 10° to 80° C.,
   treatment time in the range from 1 to 300 seconds,
c) and the workpieces are cathodically treated during phosphating with a direct current having a density in the range from 0.01 to 100 mA/cm$^2$.

It has surprisingly been found that the rate of incorporation of nickel and/or cobalt in the phosphating layers can be considerably increased by the application of a cathodic direct current to the workpiece during the phosphating process, so that, even with comparatively low concentrations of nickel and/or cobalt cations in the phosphating solution, it is possible to obtain contents in the phosphating layers as high as those which, hitherto, could only be obtained by known processes in which the phosphating solutions have comparatively high concentrations of nickel and/or cobalt cations. Another advantage of the present invention lies in the fact that the phosphate coatings obtained by the process according to the invention afford distinctly improved protection against corrosion.

It is crucially important to the present invention that all the parameters mentioned above are strictly adhered to in the practical application of the phosphating process. In other words, this means that the cathodic direct current treatment of the workpieces during the phosphating process only leads to the desired objective in suitable special phosphating solutions containing either nickel or cobalt or both cations together, as defined in detail in the foregoing.

DESCRIPTION OF PREFERRED EMBODIMENTS

In the context of the present invention, the expression "metal surfaces" is understood to be surfaces of iron, steel, zinc, aluminum and zinc or aluminum alloys. Examples of aluminum and aluminum alloy surfaces are pure aluminum, AlMg and AlMgSi alloys. Zinc may be alloyed, for example, with iron, nickel or cobalt. Steel in the context of the present invention is understood to be unalloyed or low-alloyed steel, for example of the type used in the form of plates for bodywork construction. Alloy-coated steels surface-finished with zinc/nickel alloys, for example, are also included. The process according to the invention is particularly suitable for phosphating electrolytically galvanized or hot-dip-galvanized steel strip surfaces. The use of galvanized steel, particularly electrolytically galvanized steel in strip form, has acquired increasing significance in recent years. The expression "galvanized steel" in this context encompasses galvanization both by electrolytic deposition and by hot dip application and thus relates generally to so-called "pure zinc layers" and also to known zinc alloys, particularly zinc/nickel alloys.

The process according to the invention is preferably carried out by the so-called dip method. In general, however, the phosphating solutions according to the invention may also be applied to the substrate surfaces by spray-dip treatment. For the phosphating treatment, the workpieces to be treated are connected as cathodes, an electrode of stainless steel preferably being used as the counter electrode. In general, the counter electrode may also be a metal container of the phosphating bath or even a graphite electrode or, in principle, an electrode of any material known from the relevant prior art.

In the context of the invention, the expression "direct current" means not only "pure" direct currents, but also currents of virtually the same type, for example those obtainable by full-wave rectification of a single-phase alternating current or by rectification of a three-phase alternating current. So-called pulsating direct currents and chopped direct currents may also be used for the purposes of the invention. Only the current density of the direct current is of importance to the invention and should be in the range defined above. Suitable voltage values for the direct current to be used in accordance with the present invention have been deliberately left unspecified because the different conductivities of the phosphating baths on the one hand and the geometric arrangement of the electrodes on the other hand can result in a different relationship between current and voltage. In addition, concentration gradients determined by the current density and not by the bath voltage are crucial to the mechanism by which the phosphate coatings are formed. In each individual case, one skilled in the art will select suitable voltage values on the basis of the current density values mentioned for the practical application of the process according to the invention.

One preferred embodiment of the present invention uses phosphating solutions containing the following components:

$Zn^{2+}$ cations in the range from 0.5 to 2 g/l,
$PO_4^{3-}$ anions in the range from 10 to 20 g/l
$NO_3^-$ anions in the range from 1 to 30 g/l and
$Ni^{2+}$ cations in the range from 0.5 to 2 g/l and/or
$Co^{2+}$ cations in the range from 0.5 to 2 g/l.

In another preferred embodiment of the process according to the invention, the following conditions are maintained during the phosphating treatment of the workpieces:

pH value of phosphating solutions in the range from 2 to 3,
temperature of the phosphating solutions in the range from 40° to 70° C.,
treatment time in the range from 2 to 10 seconds.

In another preferred embodiment of the invention, the workpieces are cathodically treated with a direct current having a density of 1 to 50 mA/cm$^2$ during the phosphating treatment.

In another embodiment of the process according to the invention, the phosphating baths may also contain manganese and/or magnesium cations. Although the incorporation of these cations in the phosphating layer is not significantly promoted by the application of direct current in accordance with the invention, it is also not adversely affected in any way.

In a preferred variant of this embodiment, the phosphating solutions used additionally contain $Mn^{2+}$ cations in a quantity of 0.1 to 5 g/l and preferably in a quantity of 0.5 to 2 g/l. In another preferred embodiment of the invention, the phosphating solutions used additionally contain $Mg^{2+}$ cations in a quantity of 0.01 to 2 g/l and preferably in a quantity of 0.1 to 1 g/l. The additional use of manganese and/or magnesium cations in the phosphating baths according to the invention provides for an improvement in the corrosion resistance of the phosphate coatings obtained.

In the phosphating of aluminum or aluminum alloys surfaces by the process according to the invention, the use of fluoride ions leads to more uniform coverage of the phosphate coatings on the aluminum. To this end, a preferred embodiment of the invention is characterized in that the phosphating solutions used additionally contain simple or complex fluoride anions in quantities of 0.1 to 50 g/l and preferably in quantities of 0.2 to 2 g/l. In the phosphating of surfaces of steel or zinc or galvanized steel strip, the presence of fluoride anions is not necessary, although it does not adversely affect the phosphating process according to the invention. According to the invention, the fluoride anions may also be used in the form of complex fluorine compounds, for example tetrafluoroborate or hexafluorosilicate.

As already mentioned, it is crucially important to adhere to all the parameters mentioned above for optimal application of the process according to the invention. These parameters include inter alia the pH range to be maintained. If the pH value of the phosphating bath is not in the range mentioned, the phosphating bath has to be adjusted to pH values in that range by addition of acid, for example phosphoric acid, or even by addition of an alkali, for example sodium hydroxide. The figures relating to the free acid or total acid content of the phosphating solutions mentioned in the following Examples were determined by the methods described in the literature. Accordingly, the so-called free acid point count is defined as the number of ml of 0.1N NaOH needed to titrate 10 ml bath solution against dimethyl yellow, methyl orange or bromphenol blue. Accordingly, the total acid point count is defined as the number of ml of 0.1N NaOH needed to titrate 10 ml bath solution using phenolphthalein as indicator for the first pink coloration. The phosphating solutions according to the invention generally have free acid point counts of 0.5 to 3 and total acid point counts of 15 to 20.

The phosphating baths required for carrying out the process according to the invention are generally prepared by the method known per se to the expert. The following starting products, for example, may be used for the preparation of the phosphating bath: zinc in the form of zinc oxide or zinc nitrate; nickel in the form of nickel nitrate or nickel carbonate; cobalt in the form of cobalt nitrate; manganese in the form of manganese carbonate; magnesium in the form of magnesium nitrate, magnesium oxide, magnesium hydroxide or magnesium hydroxycarbonate; phosphate, preferably in the form of phosphoric acid; nitrate in the form of the salts mentioned above and optionally also in the form of the sodium salt. The fluoride ions optionally used in the bath are preferably used in the form of sodium fluoride or in the form of the complex compounds mentioned above. The compounds mentioned are dissolved in water in the concentration ranges crucial to the invention. The phosphating solutions are then adjusted to the required pH value, as also mentioned in the foregoing.

Before the actual phosphating treatment, the metal surface to be treated must be completely wettable with water. To this end, the metal surfaces to be treated generally have to be cleaned and degreased by processes known per se, described in sufficient detail in the prior art. In another preferred embodiment of the invention, the cleaned and degreased workpieces to be phosphated, having been rinsed with water, preferably with fully deionized water, are subjected to an activating pretreatment known per se. The titanium-containing activating solutions described, for example, in DE-A-20 38 015 or DE-A-20 43 085 are particularly suitable for this purpose. Accordingly, the metal surfaces to be subsequently phosphated are treated with solutions essentially containing titanium salts and sodium phosphate, optionally together with organic components, for example alkyl phosphonates or polycarboxylic acids, as activating agents. Soluble compounds of titanium, such as potassium titanium fluoride and, in particular, titanyl sulfate are preferably used as the titanium component. Disodium orthophosphate is generally used as the sodium phosphate. The titanium-containing compounds and sodium phosphate are used in such quantities that the titanium content is at least 0.005% by weight, based on the weight of the titanium-containing compound and the sodium phosphate.

This activating treatment is followed by the actual phosphating process. The phosphated metal surfaces are then rerinsed with water, again preferably with fully deionized water. In certain cases, it can be of advantage to passivate the phosphate coatings thus produced in a subsequent process step. Passivation is always useful and of advantage when the metal surfaces phosphated by the process according to the invention are subsequently painted or otherwise coated with organic materials. As is sufficiently well known to one skilled in the art, the passivation step may be carried out, for example, with dilute chromic acid or with mixtures of chromic and phosphoric acid. The concentration of the chromic acid is generally between 0.01 and 1 g/l. An alternative is the passivating treatment with chromium-free products which is described, for example, in DE-A-31 46 265 or DE-A-40 31 817. However, if thereafter the phosphated substrates are first subjected to a mechanical forming process and then rephosphated, as for example in bodywork construction, the passivating treatment should be omitted.

The phosphate coatings produced by the process according to the invention may be effectively used for any applications requiring phosphate coatings. One particularly advantageous application is the preparation of the metal surfaces for painting, for example by spraying or electrodeposition, or for coating with organic films.

The process according to the invention is illustrated by the following Examples.

EXAMPLES

The compositions of the phosphating baths used, including the particular pH values and the free acid and total acid contents, are shown in Table 1 below for Examples 1 to 9 according to the invention and for Comparison Examples 1 to 3.

In Examples 1 to 8 according to the invention, a cathodic direct current with a current density of 10 mA/cm$^2$ was applied to the test plate throughout the immersion treatment thereof in the particular phosphating baths. In Example 9 according to the invention, the current density was 2 mA/cm$^2$. In every case, the counter electrode was an electrode of stainless steel.

By contrast, in Comparison Examples 1 to 3, no direct current was applied during the phosphating process. The phosphating baths used for Comparison Examples 1 and 3 contained the cations of nickel and cobalt relevant to the present invention in considerably higher concentrations than the Examples according to the invention. The composition of the phosphating bath in Comparison Example 2 corresponded to the "trication process" now typically applied in practice, i.e., the phosphating bath contained Zn, Ni and Mn.

The test plates used for all the Examples and Comparison Examples were electrolytically galvanized steel plates obtainable from Thyssen AG, Düsseldorf (dimensions: 10 cm×20 cm×0.7 cm; zinc applied to both sides in a layer thickness of 7.5 μm). Except for the treatment with direct current discussed in the foregoing, the test plates used in the Examples and Comparison Examples were treated in the same way by the following process steps:

1) Chemical spray cleaning and degreasing for 3 minutes at about 60° C. using a surfactant- and phosphate-containing alkaline cleaning preparation (Ridoline ®C 1250 E, a product of Henkel KGaA) in the form of an aqueous solution with a concentration of 2% by weight.

TABLE 1

| Example No. | Composition of the phosphating baths | | | | | | | | | |
|---|---|---|---|---|---|---|---|---|---|---|
| | $Zn^{2+}$ | $Ni^{2+}$ | $Co^{2+}$ | $Mn^{2+}$ in [g/l] | $Mg^{2+}$ | $NO^-_3$ | $PO^{3-}_4$ | pH | Free acid points | Total acid points |
| 1 | 1.6 | 1 | — | — | — | 2.1 | 12.3 | 2.5 | 2.2 | 19 |
| 2 | 1.6 | 1 | 1 | — | — | 4.2 | 12.3 | 2.8 | 1.3 | 18 |
| 3 | 1.6 | 1 | — | 1 | — | 4.4 | 12.3 | 2.5 | 2.2 | 20 |
| 4 | 1.6 | — | 1 | 1 | — | 4.4 | 12.3 | 2.8 | 1.3 | 19 |
| 5 | 1.6 | 1 | 1 | 1 | — | 6.5 | 12.3 | 2.5 | 2.2 | 20 |
| 6 | 1.6 | 1 | — | — | — | 2.1 | 10.7 | 3.0 | 0.9 | 18 |
| 7 | 1.6 | — | 1 | — | — | 2.1 | 10.7 | 2.5 | 2.2 | 19 |
| 8 | 1.6 | — | 1 | — | — | 2.1 | 10.7 | 3.0 | 0.6 | 17 |
| 9 | 1.6 | 1 | — | — | 0.1 | 3.0 | 12.3 | 2.3 | 2.9 | 20 |
| Comp. 1 | 0.6 | 5.1 | — | — | — | 10.2 | 16.0 | 3.5 | 1.6 | 35 |
| Comp. 2 | 0.6 | 0.9 | — | 1 | — | 1.8 | 11.5 | 3.5 | 1.2 | 22 |
| Comp. 3 | 0.6 | — | 5.1 | — | — | 10.2 | 16.0 | 3.5 | 1.8 | 34 |

Comp. = Comparison Example

2) Rinsing with fully deionized water for 30 seconds at room temperature.
3) Spray activation for 5 seconds at room temperature using a titanium-salt-containing aqueous activating preparation (Fixodine ®950, a product of Henkel KGaA) in a concentration of 0.3% by weight.
4) Dip phosphating for 5 seconds at 60° C. in the phosphating baths according to Table 1.
5) Rinsing with fully deionized water for 30 seconds at room temperature.
6) Drying for 10 minutes at an object temperature of 80° C.

After drying, the test plates were painted with an epoxy-based cathodic electrodeposition lacquer (Aqualux ®K, a product of ICI, Hilden). The dry film thickness was 18±2 μm. The corrosion resistance of the particular phosphate coatings was then evaluated by determination of lacquer creepage by a cathodic polarization test. To this end, a single cut was made in each or the test plates in accordance with DIN 53 167, after which the test plates were immersed in a 10% by weight aqueous $Na_2SO_4$ solution with a current flow of 0.75 A over a polarization time of 40 hours. The lacquer creepage was evaluated in accordance with DIN 53 167 (see Table 2, a).

In addition, the corrosion resistance of the particular phosphate coatings was tested by the alternating climate test according to VDA 62 415. To this end, phosphated and lacquered test plates were provided with a single cut in accordance with DIN 53 167 and then subjected to the alternating climate test over a period of 10 weeks (=10 cycles). Each one-week cycle was based on the following program:

1st day: salt spray test according to DIN 50 021 for 24 hours;
2nd to 5th day: condensation/alternating climate according to DIN 50 017 KFW;
6th to 7th day: storage at room temperature in accordance with DIN 50 014.

Lacquer creepage was again evaluated in accordance with DIN 53 167 (see Table 2, b).

In addition, the phosphate coatings on the particular test plates were removed with chromic acid and analyzed by ICP spectroscopy to determine their composition.

The results obtained in the tests mentioned above are set out in Table 2 below.

TABLE 2

| Example No. | Content of Ni, Co, Mn or Mg in the phosphate coatings and corrosion test results: Ni | Co | Mn | Mg | Lacquer creepage [mm] a | b |
|---|---|---|---|---|---|---|
| | in atom-% | | | | | |
| 1 | 5 | — | — | — | 8 | 1.4 |
| 2 | 4 | 7 | — | — | 7 | 1.4 |
| 3 | 6 | — | —* | — | 4 | 1.2 |
| 4 | — | 6 | 9 | — | 3 | 1.2 |
| 5 | 4 | 3 | 8 | — | 5 | 1.0 |
| 6 | 12 | — | — | — | 4 | 0.7 |
| 7 | — | 6 | — | — | 9 | 1.6 |
| 8 | — | 11 | — | — | 4 | 1.1 |
| 9 | 3 | — | — | 5 | 5 | 0.9 |
| Comp. 1 | 12 | — | — | — | 6 | 1.2 |
| Comp. 2 | 2 | — | 11 | — | 8 | 2.1 |
| Comp. 3 | — | 13 | — | — | 6 | 1.4 |

* = Mn cannot be detected in the layer
[a]= Cathodic polarization test
[b]= Alternating climate test Comparison of the values in Table 1—relating to the composition of the phosphating baths—with the values in Table 2—relating to the content of cations relevant to the present invention in the phosphate coatings, particularly Ni and Co—shows that comparatively high contents of these cations can be obtained in the phosphate coatings formed by the process according to the invention despite relatively low concentrations of the cations in the phosphating baths. In cases where the Examples according to the invention are comparable with the Comparison Examples, this leads to a distinct improvement in corrosion resistance, cf. Example 6 with Comparison Example 1, Example 3 with Comparison Example 2 and Example 8 with Comparison Example 3.

The invention claimed is:

1. A process for phosphating metal surfaces selected from the group consisting of iron, steel, zinc, zinc alloy, aluminum, and aluminum alloy surfaces by the dip or spray-dip treatment thereof with acidic aqueous solutions comprising:

$Zn^{2+}$ cations in a quantity of 0.1 to 5 g/l,
$PO_4^{3-}$ anions in a quantity of 5 to 50 g/l,
$NO_3^-$ anions in a quantity of 0.1 to 50 g/l and
$Ni^{2+}$ cations in a quantity of 0.1 to 5 g/l and/or
$Co^{2+}$ cations in a quantity of 0.1 to 5 g/l, said acidic aqueous solutions having:

pH values in the range from 1.5 to 4.5 and
temperatures in the range from 10° to 80° C. and
remaining in contact with the metal surfaces for a treatment time in the range from 1 to 300 seconds, the metal surfaces being cathodically treated during phosphating with a direct current having a density in the range from 0.01 to 100 mA/cm$^2$.

2. A process as claimed in claim 1, wherein the acidic aqueous solutions used contain the following components:

$Zn^{2+}$ cations in a quantity of 0.5 to 2 g/l,
$PO_4^{3-}$ anions in a quantity of 10 to 20 g/l,
$NO_3^-$ anions in a quantity of 1 to 30 g/l and
$Ni^{2+}$ cations in a quantity of 0.5 to 2 g/l and/or
$Co^{2+}$ cations in a quantity of 0.5 to 2 g/l.

3. A process as claimed in claim 2, wherein the following conditions are maintained during the phosphating:

pH value of the acidic aqueous solutions in the range from 2 to 3, temperature of the acidic aqueous solutions in the range from 40° to 70° C., treatment time in the range from 2 to 10 seconds.

4. A process as claimed in claim 3, wherein the metal surfaces are cathodically treated with a direct current having a density of 1 to 50 mA/cm$^2$ during the phosphating process.

5. A process as claimed in claim 4, wherein the acidic aqueous solutions used additionally contain $Mn^{2+}$ cations in a quantity of 0.5 to 2 g/l.

6. A process as claimed in claim 4, wherein the acidic aqueous solutions used additionally contain $Mg^{2+}$ cations in a quantity of 0.1 to 1 g/l.

7. A process as claimed in claim 6, wherein the acidic aqueous solutions used additionally contain simple or complex fluoride anions in a quantity of 0.2 to 2 g/l.

8. A process as claimed in claim 7, wherein the metal surfaces to be phosphated are subjected beforehand to an activating pretreatment with titanium-containing activating solutions.

9. A process comprising steps of (i) a process as claimed in claim 1 and (ii) a step of subsequent painting or coating over the surface formed in the process as claimed in claim 1.

10. A process as claimed in claim 1, wherein the metal surfaces treated are electrolytically galvanized or hot-dip-galvanized steel strip surfaces.

11. A process as claimed in claim 10, wherein the following conditions are maintained during the phosphating:

pH value of the acidic aqueous solutions in the range from 2 to 3, temperature of the acidic aqueous solutions in the range from 40° to 70° C., treatment time in the range from 2 to 10 seconds.

12. A process as claimed in claim 10, wherein the metal surfaces are cathodically treated with a direct current having a density of 1 to 50 $mA/cm^2$ during the phosphating process.

13. A process as claimed in claim 10 wherein the acidic aqueous solutions used additionally contain $Mn^{2+}$ cations in a quantity of 0.1 to 5 g/l.

14. A process as claimed in claim 10 wherein the acidic aqueous solutions used additionally contain $Mg^{2+}$ cations in a quantity of 0.01 to 2 g/l.

15. A process as claimed in claim 10, wherein the acidic aqueous solutions used additionally contain simple or complex fluoride anions in a quantity of 0.1 to 50 g/l.

16. A process as claimed in claim 1, wherein the following conditions are maintained during the phosphating:

pH value of the acidic aqueous solutions in the range from 2 to 3, temperature of the acidic aqueous solutions in the range from 40° to 70° C., treatment time in the range from 2 to 10 seconds.

17. A process as claimed in claim 1, wherein the metal surfaces are cathodically treated with a direct current having a density of 1 to 50 $mA/cm^2$ during the phosphating process.

18. A process as claimed in claim 1 wherein the acidic aqueous solutions used additionally contain $Mn^{2+}$ cations in a quantity of 0.1 to 5 g/l.

19. A process as claimed in claim 1 wherein the acidic aqueous solutions used additionally contain $Mg^{2+}$ cations in a quantity of 0.01 to 2 g/l.

20. A process as claimed in claim 1, wherein the acidic aqueous solutions used additionally contain simple or complex fluoride anions in a quantity of 0.1 to 50 g/l.

* * * * *